US007025654B2

(12) United States Patent
Oren et al.

(10) Patent No.: US 7,025,654 B2
(45) Date of Patent: Apr. 11, 2006

(54) TOY MOBILE

(75) Inventors: Shoshana Oren, Herzlia Ha'zeira (IL); Zafrira Weisman, Kiriat Ono (IL); Roni Golos, Kiriat Ono (IL)

(73) Assignee: Tiny Love Ltd., Tel-Aviv (IL)

( * ) Notice: Subject to any disclaimer, the term of this patent is extended or adjusted under 35 U.S.C. 154(b) by 0 days.

(21) Appl. No.: 10/276,959

(22) PCT Filed: Apr. 19, 2001

(86) PCT No.: PCT/IL01/00362

§ 371 (c)(1),
(2), (4) Date: Apr. 17, 2003

(87) PCT Pub. No.: WO01/89651

PCT Pub. Date: Nov. 29, 2001

(65) Prior Publication Data

US 2004/0005839 A1 Jan. 8, 2004

(30) Foreign Application Priority Data

May 22, 2000 (IL) ..... 136277

(51) Int. Cl.
*A63H 33/00* (2006.01)

(52) U.S. Cl. ..... 446/227; 446/228

(58) Field of Classification Search ..... 446/227
See application file for complete search history.

(56) References Cited

U.S. PATENT DOCUMENTS

| | | | | |
|---|---|---|---|---|
| D147,776 | S | 11/1947 | Backeman | |
| 3,638,602 | A * | 2/1972 | Carreno | 446/227 |
| 3,927,482 | A * | 12/1975 | Marcus | 40/455 |
| 3,978,610 | A | 9/1976 | Stubbmann | |
| 3,983,647 | A * | 10/1976 | Stubbmann | 40/430 |
| D278,446 | S | 4/1985 | Kujawski et al. | |
| 5,112,268 | A * | 5/1992 | Klaus | 446/489 |
| D349,735 | S | 8/1994 | Cacciola et al. | |
| 5,620,274 | A * | 4/1997 | Wear | 403/171 |
| 5,803,786 | A * | 9/1998 | McCormick | 446/227 |
| 6,068,535 | A * | 5/2000 | Hoyt | 446/227 |

FOREIGN PATENT DOCUMENTS

GB 2 019 229 A 10/1979

* cited by examiner

*Primary Examiner*—Julie Brocketti
(74) *Attorney, Agent, or Firm*—Birch, Stewart, Kolasch & Birch, LLP

(57) ABSTRACT

A toy mobile comprising a spider having a hub drivable by a motor to rotate the spider and having at least two legs radiating from the hub at an angle thereto, each leg having an end terminal which in the course of each rotating cycle of the spider traverses a circular orbit about the hub that is slanted with respect to a horizontal plane passing through the hub, whereby the terminal in the course of each cycle rises to a level above the hub and then fall to a level below the hub and at least one geometric object dangling from the terminal which is animated as a terminal traverses the orbit.

30 Claims, 5 Drawing Sheets

TOY MOBILE

This application is the national phase under 35 U.S.C. § 371 of PCT International Application No. PCT/IL01/00362 which has an International filing date of Apr. 19, 2001, which designated the United States of America.

FIELD OF THE INVENTION

This invention relates generally to toy mobiles, and in particular to a mobile which presents to an infant an animated display of diverse geometric objects.

The term geometric objects as used herein the specification and claims denotes any shape and pattern such as geometric figures e.g. circles, rectangular, square etc., or figurative shapes e.g. shapes of animals or objects. The geometric objects may be colorful or with black and white patterns or any desirable pattern.

BACKGROUND OF THE INVENTION

The ability to recognize differences in the shapes and sizes of various objects is not innate or inherent but must be acquired. This is best taught at an early age by play, for the most effective toy for a child is one which instructs as well as entertains the player.

A classic toy serving to teach a child how to distinguish between objects which differ in shape, color and size, provides a player with a set of diverse geometric objects and a playing board having apertures therein. Each aperture in the board has a geometry which corresponds to only one of the pieces in the set. Hence when a player seeks to fit a triangular piece into an aperture, by trial and error he finds the one aperture in the board that will accept the triangular piece. The child in playing with this toy must take size into account. Thus if an aperture on the board is a circular opening with a one inch diameter, it will not accept a circular disc having a one-and-a-half inch diameter.

An infant who occupies a crib or a carriage is incapable of manipulating geometric pieces to play with the above described toy. However, this infant has powers of observation. Hence if geometric objects that differs in shape, size and color are collectively displayed, the infant is then able to discern the significant features among these objects. This is particularly true if the collection of objects is not in a static state and the objects are animated so that they can each be seen in the round.

Since the invention relates to a mobile, of prior art interest are the art mobiles created by Alexander Calder. These can be seen in major museums of modern art.

In a Calder mobile, colored sheet metal pieces having different geometries dangle from an armature that is supported from a ceiling; the pieces being free to swing. The distribution of the pieces and their relative weights are such that in a static state the armature is balanced and the mobile then appears to be a work of abstract sculpture. But the balance is upset by natural air currents flowing in the space occupied by the mobile. These currents impinge on the sheet metal pieces and cause them to sway, thereby animating the mobile. Calder has also created works in which the geometric pieces are maintained in fixed positions, this being referred to as stabiles.

A toy mobile in accordance with the invention is not activated by air currents in the manner of a Calder mobile but is motor driven causing three-dimensional geometric objects to undergo complex motions.

Other prior art toy mobiles comprise one or more articles fitted at an end of an arm, either static where motion is obtained by air current, or rotatable about a fixed axis by a motor.

SUMMARY OF THE INVENTION

In view of the foregoing the main object of the invention is to provide a motorized toy mobile that creates an animated display of three-dimensional geometric objects. Typically, the geometric objects differ from each other in shape, size, weight and color.

More particularly, an object of this invention is to provide a mobile of the above-type adapted to be installed at any suitable location such as in a crib for an infant, a bed or in a baby carriage etc, collectively referred to hereinafter as a crib, where its occupant can observe the animated display of geometric objects and be instructed thereby as to differences therebetween.

A significant advantage of a toy mobile in accordance with the invention is that it does far more than merely entertain an infant exposed to the mobile. By presenting the infant with a collection of contrasting geometric objects in close proximity to each other, with the object in motion so that all sides of the object can be seen, the infant then gains an appreciation of the distinctions therebetween in regard to size, shape and color, and learns to recognize the unique aspect of each piece.

Also an object of the invention is to provide a music box associated with the motorized mobile, the box playing music to accompany the animated display of geometric pieces which appear to be moving or dancing.

Briefly stated, these objects are accomplished by a toy mobile for entertaining an infant occupying a crib, the mobile being supported so that it is viewable by the infant, typically above the crib. The mobile is provided with a motor-driven spider having a hub and at least two legs radiating therefrom at an angle thereto whereby as the spider rotates, the terminal at the end of each leg then traverses a circular orbit that is slanted with respect to a horizontal plane passing through the hub.

Pivoted on each terminal is the apex of an article supporting member from whose opposite sides dangle two geometric pieces that differ in shape, size, weight and color, the pieces unbalancing the article supporting member, which is typically, but not necessary, is in the shape of a conical cap. When the spider rotates, the article supporting members and the pieces hanging therefrom then travel in the paths of the inclined orbits, in the course of which during each rotary cycle of the spider, the pieces differentially loading the article supporting members causing them to more or less tilt and flip into a new location under influence of gravity acting on the articles suspended from the article supporting member.

The performance of the mobile which presents to the infant an animated display of diverse geometric objects in which the pieces appearing to be dancing is accompanied by music appropriate to the dance.

BRIEF DESCRIPTION OF THE DRAWINGS

In order to understand the invention and to see how it may be carried out in practice, some embodiments will now be described, by way of non-limiting examples only, with reference to the accompanying drawings, in which.

DETAILED DESCRIPTION OF THE INVENTION

Figure 1:
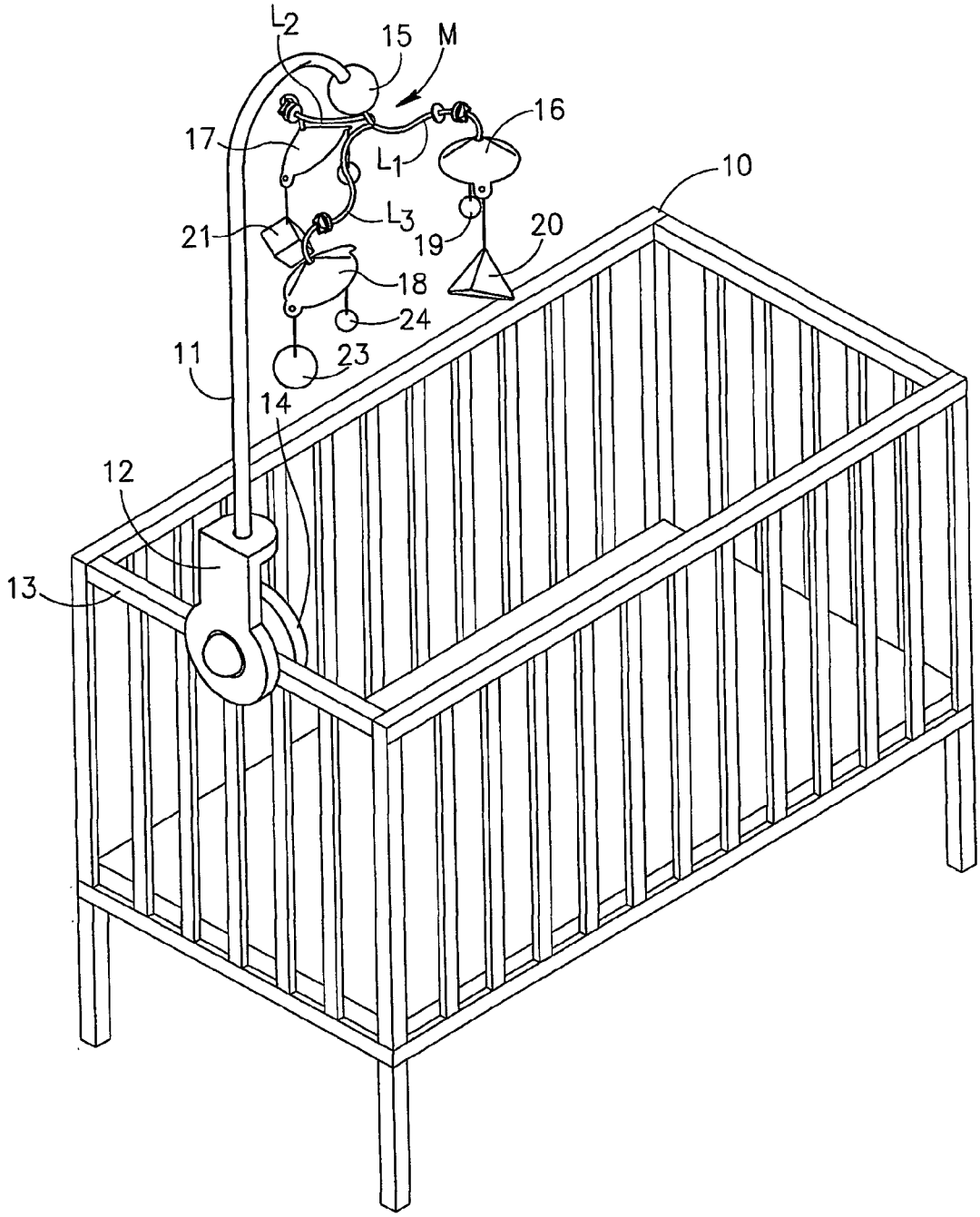
FIG. 1 illustrates a crib having installed therein a toy mobile in accordance with the invention that is viewable by an infant occupying the crib.
Figure 2A:
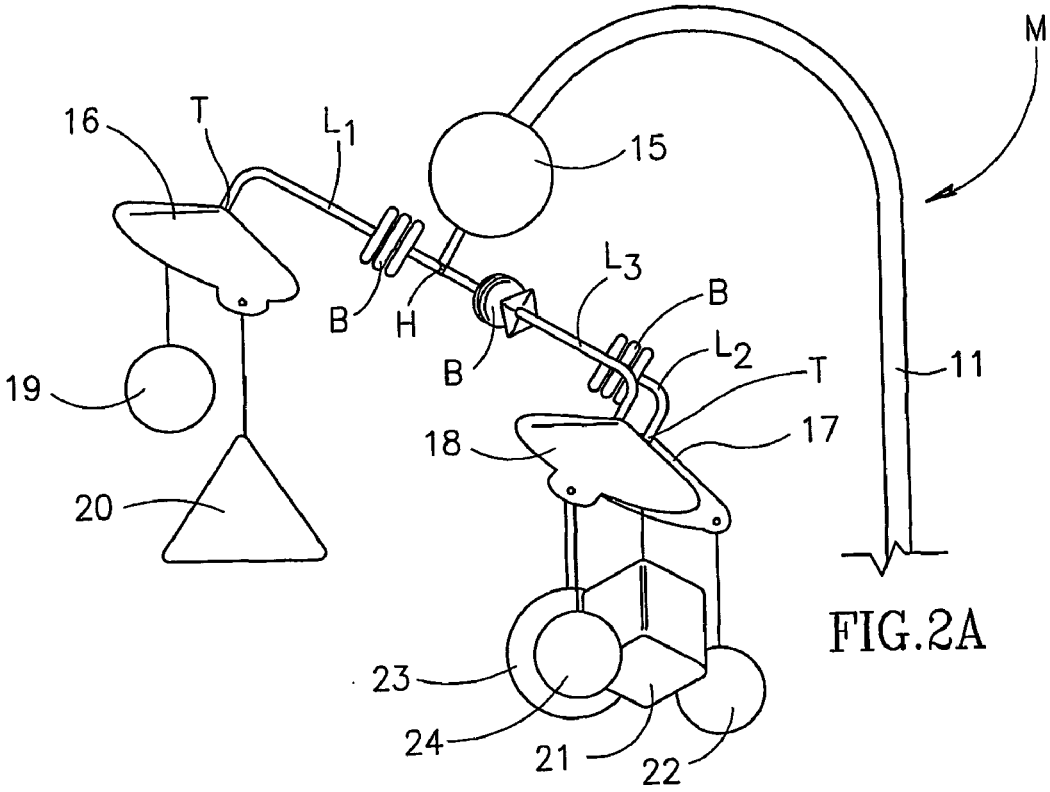
FIG. 2A is a front view of the toy mobile at the start of its rotation.
Figure 2B:
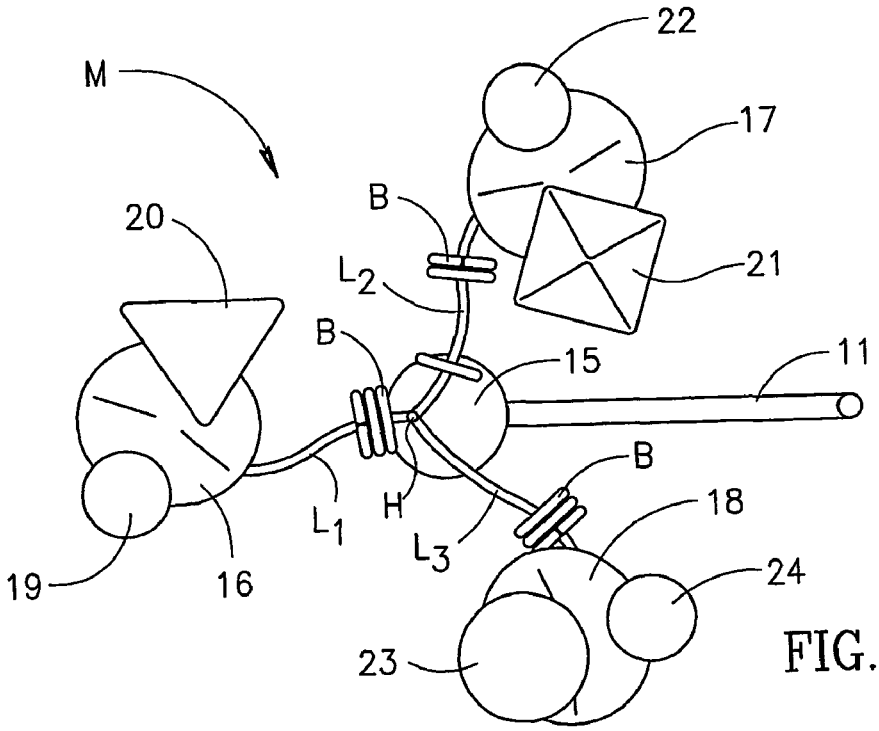
FIG. 2B is a bottom view of the mobile shown in FIG. 2A, this view illustrating the position of the three legs of the mobile spider and the start of rotation.
Figure 3A:
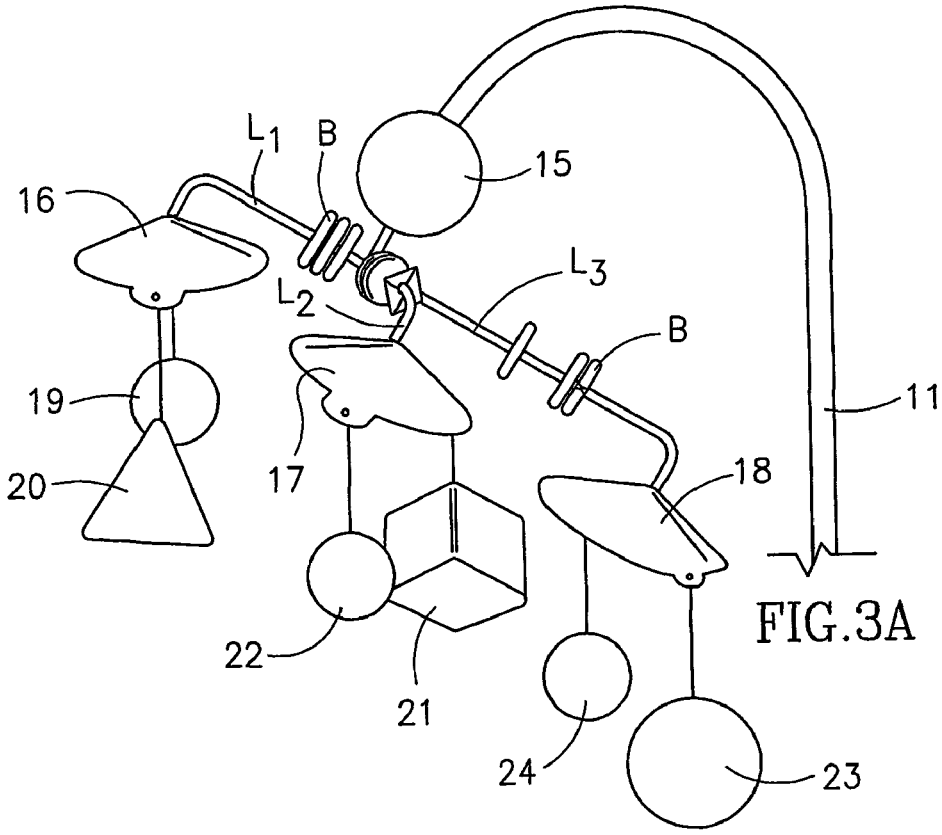
FIG. 3A is a front view of the mobile whose spider is now rotating in a counterclockwise direction.
Figure 3B:
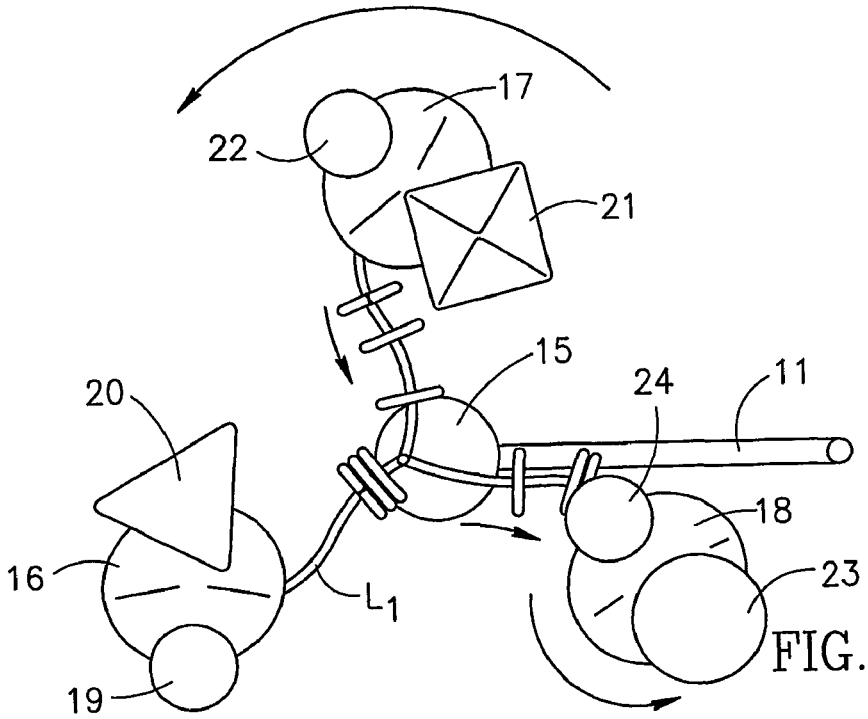
FIG. 3B is a bottom view of the spider shown in FIG. 3A.
Figure 4A:
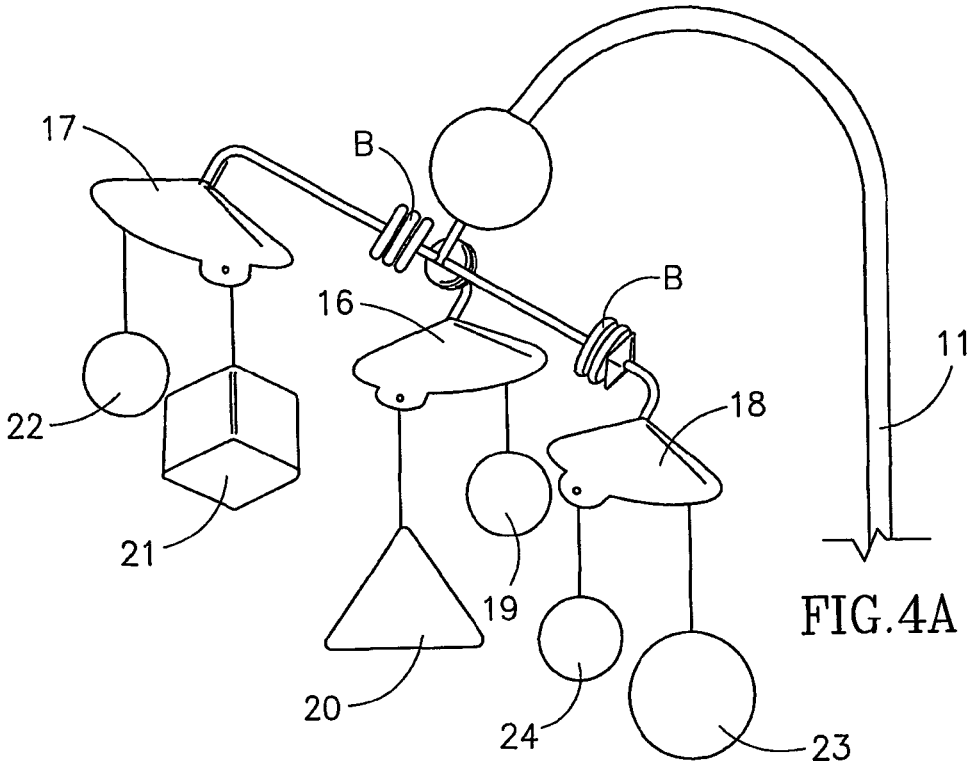
FIG. 4A is a front view of the mobile showing the position assumed by the spider when partway through a rotary cycle.
Figure 4B:
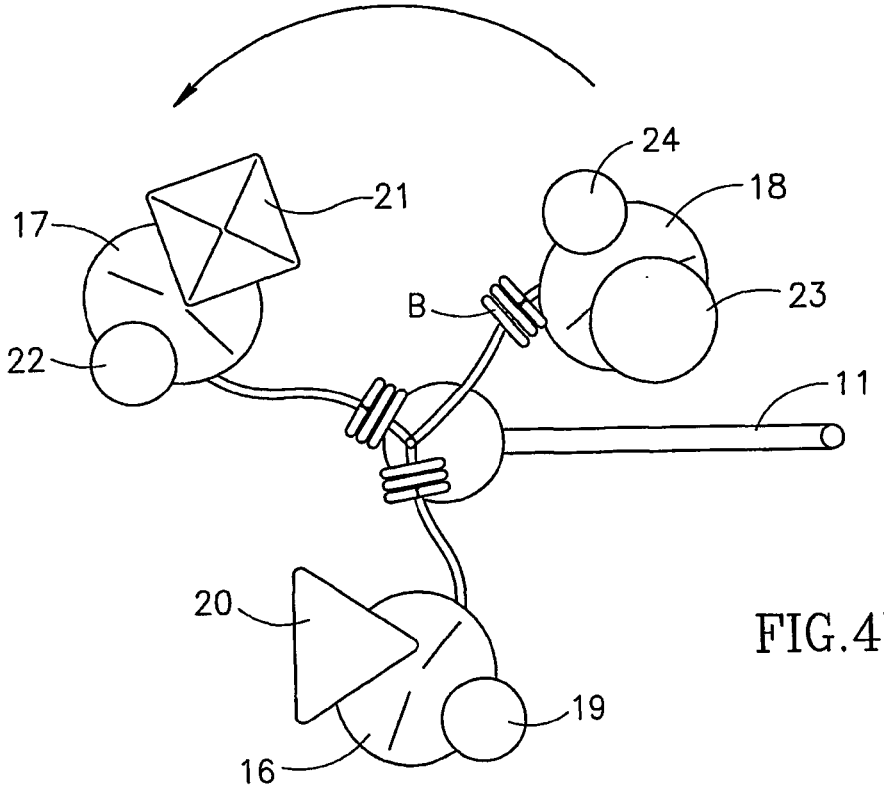
FIG. 4B is a bottom view of the mobile shown in FIG. 4A.

Referring now to FIGS. 1, 2A and 2B shown in these figures is a toy mobile M in accordance with the invention, this mobile being supported above a crib 10 for accommodating an infant. The mobile is so placed that it is viewable by the infant.

Mobile M is supported by a vertical post 11 extending upwardly from a bracket 12 clamped to a side rail 13 of the crib. Associated with mobile 12 is a music box 14 having stored therein one or more pieces of music whose character is appropriate to the animated display produced by the mobile, or any other pleasing music. The music box is provided with a selector switch or push buttons to select the piece to be reproduced to accompany the display of the geometric pieces of the mobile which appear to be dancing when the mobile rotates.

The music box in combination with the mobile creates an entertainment center for the infant in which the same show is essentially not repeated, for with each change in the music being played, the geometric three-dimensional objects of the mobile then appear to be dancing to a different tune. As with adults, an infant loses interest in an entertainment which simply repeats what had previously been presented.

Mobile M supported on post 11 is provided with a spider whose hub H is operatively coupled to a battery-powered dc motor enclosed in a ball-like casing 15. This casing is anchored on the crook at the upper end of post 11. The batteries of the motor may be housed in a battery compartment in music box 14. Radiating from hub H at an angle thereto are three sinuously-curved legs L1, L2 and L3. According to an alternative, the motor is received within the housing of the music box and motion is transmitted via a flexible rod extending through the post which is than made hollow.

Each leg terminates at its free end in a terminal T to which is pivotally coupled the apex of an article supporting member in the shape of a conical cap, so that the respective cap is free to swing from the terminal in any direction. The article supporting member is referred to herein also as cap. Terminal T of arm L1 is coupled to a conical cap 16, terminal T of arm L2 is coupled to a conical cap 17, and terminal T of arm L3 is coupled to a conical cap 18.

Hanging from each of these caps 16, 17 and 18, by wires connected to opposite sides of the cap at diametrically-opposed points thereon, are three-dimensional geometric pieces which differ from each other in size, shape, weight and color. Thus hanging from cap 16 are pieces 19 and 20, piece 19 being a small ball and piece 20 being a large pyramid having three triangular sides. Hanging from cap 17 is a relatively large cubical piece 21 and a small ball 22. Hanging from cap 18 is a large ball 23 and a smaller ball 24. However, it will be appreciated that these are mere examples and the articles may have any other shape and form e.g. animals or shapes of other objects.

The larger pieces which hang from the caps are somewhat heavier than the smaller pieces (obviously, size and weight do not necessary correlate). Hence the two three-dimensional geometric objects which hang from opposite sides of each conical cap which is symmetrical in form act to unbalance the cap which in the absence of these pieces would be balanced with respect to a vertical axis running through the apex of the cap.

All of the pieces included in the mobile are preferably molded of synthetic plastic material such as polypropylene or polyethylene and have no sharp edges. In practice, several or all parts of the mobile may be protectively covered by a soft fabric material.

Because legs L1, L2 and L3 radiating from hub H are angled with respect to the hub, as the spider rotates, each terminal T of the free end of a leg then traverses a circular orbit about the hub H. This orbit is slanted with respect to a horizontal plane passing through the hub.

Hence in the course of each rotary cycle of the spider, each cap pivoted on terminal T of a spider leg and the two geometric pieces dangling therefrom travel in a circular path that is inclined with respect to the horizontal plane. In the course of this travel, the cap which is differentially loaded by the two pieces rises to a level higher than hub H and then falls to a level below hub H. As this motion takes place, the tilt of the cap caused by two objects hanging therefrom also changes.

Figure 5A:
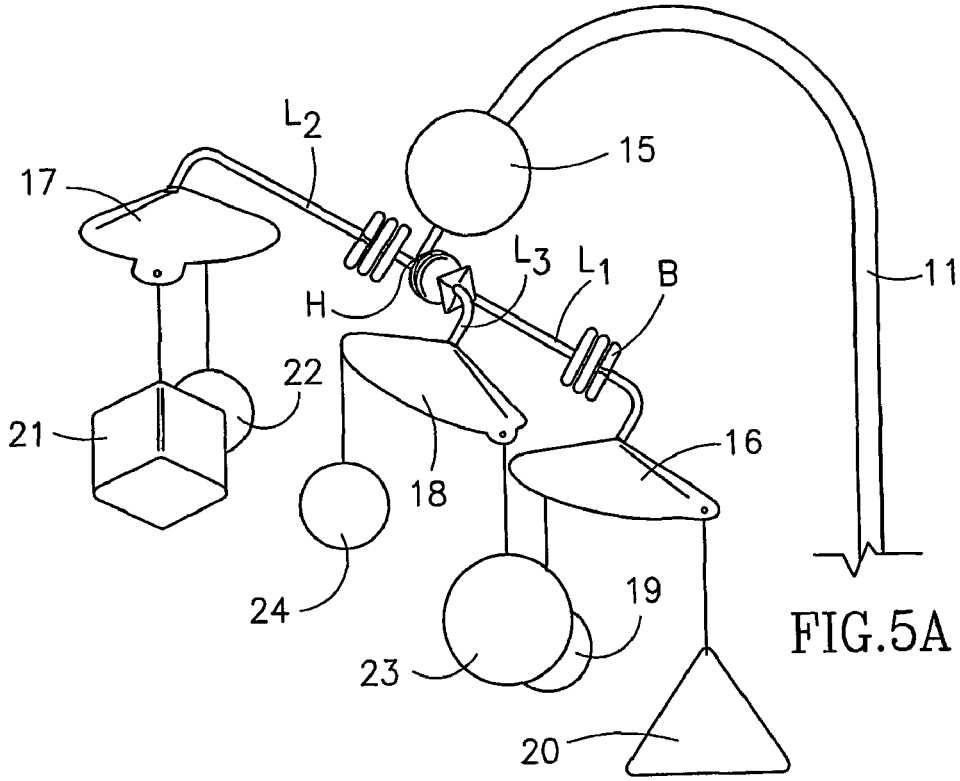
FIG. 5A is a front view of the mobile later in the rotary cycle.
Figure 5B:
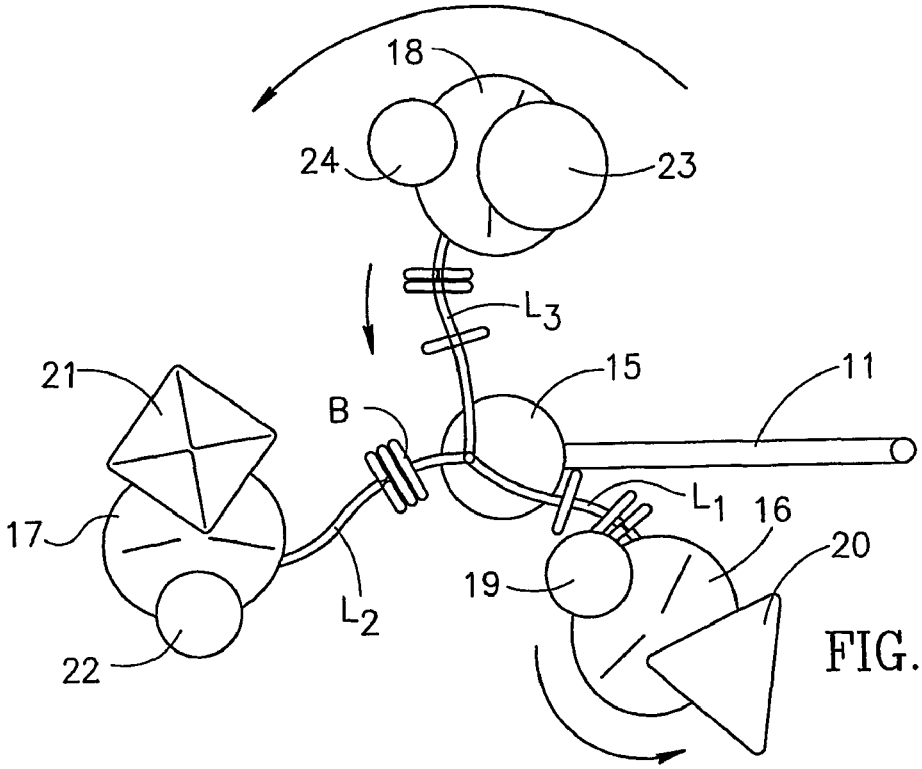
FIG. 5B is a bottom view of the mobile shown in FIG. 5A.

Thus FIG. 2A shows cap 16 and the pieces 19 and 20 hanging therefrom, with the cap 16 being at a level above hub H and being sharply tilted. FIG. 5A shows the same cap 16 at a level below hub H and being less tilted with respect to the horizontal plane.

Mounted on each of the sinuous legs L1, L2 and L3 and slidable thereon are annular beads B which have different colors. The beads however, may have any other shape as well. When a leg of the spider in the course of a rotary cycle is upwardly angled with respect to the hub of the spider, the beads B on this leg, as a result of gravity, then slide down a sinuous path toward the hub. But when the leg is downwardly angled with respect to the hub, the beads then slide away from the hub. Hence as the mobile rotates, the infant sees beads B riding up and down the legs of the spider.

The three-dimensional objects hanging from the conical caps and differentially loading these caps go up and down as the spider rotates, while concurrently the beads slide up and down the legs as the caps more or less tilt or flip. The overall effect is that of an animated display in which geometric objects on a carousel appear to be dancing with the music being played.

By an embodiment of the invention, the speed of the motor may be made controllable so that the mobile can be switched to rotate at a slow, medium or a fast speed. Similarly, the music box may be arranged to selectively reproduce music whose beat is slow, medium or rapid. In this way, the music that is played is appropriate to the rotary rate of the mobile and is effectively synchronized with the displacement of the geometric objects in the animated display.

While the mobile has been illustrated in a crib installation, it may be installed on a baby carriage by means of a cross bar having side arms which are clamped to the sides of the carriage. Or it may be installed in a playpen or elsewhere in a play area. And while there has been shown a preferred embodiment of a mobile in accordance with the invention, it is to be understood that many changes may be made therein without departing from the spirit of the invention.

The invention claimed is:

1. A toy mobile comprising:

(a) a spider carrying toy elements, having a hub drivable by a motor to rotate the spider and having at least two legs radiating from the hub at an angle thereto, said legs having end terminals which in the course of each rotating cycle of the spider traverse a circular orbit about the hub that is slanted with respect to a horizontal plane passing through the hub, whereby each terminal in the course of each cycle rises to a level above the hub and then falls to a level below the hub; wherein (b) at least some of said toy elements are movably mounted on said spider so as to change, in the course of each rotary cycle thereof, their location relative to the terminals of the legs of the spider, under the influence of gravity.

2. A toy mobile according to claim 1, wherein some of said toy elements are slideably mounted on said legs of the spider to slide toward and away from the hub in the course of a rotating cycle.

3. A toy mobile as set forth in claim 2, wherein the toy elements slideably mounted on said legs are in the form of annular beads.

4. A toy mobile as set forth in claim 2, in which at least one of said legs has a sinuous form, causing the toy elements mounted thereon to travel in a sinuous path.

5. A toy mobile as set forth in claim 1, in which the toy elements have different colors and shapes.

6. A toy mobile as set forth in claim 1, in which pivoted on each terminal is an article supporting member, some of the toy elements dangling from different sides of each article supporting members.

7. A toy mobile as set forth in claim 6, in which the toy elements dangling from different sides of the article supporting member differ in weight and differentially load the article supporting member to cause it to change its tilt in the course of rotating cycle.

8. A toy mobile as set forth in claim 1, in combination with a music box adapted to play music as the spider rotates.

9. A toy mobile as set forth in claim 8, wherein the played music is based on to the rate of rotation of the rotating mobile.

10. A toy mobile comprising:

(a) a spider having a hub drivable by a motor to rotate the spider, and having at least two legs radiating from the hub at an angle thereto, each leg having an end terminal which in the course of each rotating cycle of the spider traverses a circular orbit about the hub that is slanted with respect to a horizontal plane passing through the hub, whereby each said terminal in the course of each cycle rises to a level above the hub and then falls to a level below the hub;

(b) an article supporting member pivoted on each terminal; and (c) toy objects dangling from different sides of the article supporting member, animated as each terminal traverses the orbit, wherein (d) said objects differ in weight and differentially load the article supporting member to cause it to change its tilt in the course of each rotating cycle under the influence of gravity.

11. A toy mobile according to claim 10, wherein each said article supporting member has a periphery spaced from its respective terminal and said objects dangle from said periphery.

12. A toy mobile according to claim 11, wherein said periphery extends continuously around said respective terminal.

13. A toy mobile comprising:

(a) a spider having a hub drivable by a motor to rotate the spider; and having at least two legs radiating from the hub at an angle thereto, each leg having an end terminal which in the course of each rotating cycle of the spider traverses a circular orbit about the hub that is slanted with respect to a horizontal plane passing through the hub, whereby each terminal in the course of each cycle rises to a level above the hub and then falls to a level below the hub;

(b) at least one toy object dangling from at least one said terminal which is animated as a terminal traverses the orbit; and (c) beads slideably mounted on said legs of the spider which, in the course of a rotating cycle, slide toward and away from the hub under the influence of gravity.

14. A toy mobile according to claim 13, wherein each leg has a plurality of beads mounted thereon.

15. A toy mobile comprising:

(a) a spider having a hub drivable by a motor to rotate the spider, and having at least two legs radiating from the hub at an angle thereto, each having an end terminal which, in the course of rotating cycle of the spider, rises to a level above the hub when the leg is upwardly angled with respect to the hub, and then falls to a level below the hub when the leg is downwardly angled with respect to the hub, and (b) toy elements movably mounted on the legs of the spider so as to change their location relative to the terminals of said legs under the influence of gravity.

16. A toy mobile according to claim 15, wherein some of said toy elements are slideably mounted on said legs of the spider to slide toward and away from the hub and/or the terminal in the course of a rotating cycle.

17. A toy mobile as set forth in claim 16, wherein the toy elements slideably mounted on said legs are in the form of annular beads.

18. A toy mobile as set forth in claim 16, in which the legs have a sinuous form, causing the toy elements mounted thereon to travel in a sinuous path.

19. A toy mobile as set forth in claim 15, in which the toy elements have different colors and shapes.

20. A toy mobile according to claim 19, wherein each leg has a plurality of beads mounted thereon.

21. A toy mobile as set forth in claim 15, further comprising an article supporting member pivoted on each terminal, and toy objects dangling from different sides of the article supporting members of the terminals.

22. A toy mobile as set forth in claim 21, in which the toy objects dangling from different sides of the article supporting member constitute at least part of said toy elements and differ in weight to differentially load the article supporting member to cause it to change its tilt in the course of a rotating cycle, leading to a change of their location relative to the end terminal.

23. A toy mobile as set forth in claim 21, in which the toy objects are in the form of geometrical objects.

24. A toy mobile as set forth in claim 15, further comprising a music box adapted to play music as the spider rotates.

25. A toy mobile as set forth in claim 24, wherein the played music is based on to the rate of rotation of the rotating mobile.

26. A toy mobile comprising:

(a) a spider having a hub drivable by a motor to rotate the spider around the hub; and having at least two legs radiating from the hub at an angle thereto, each leg having an end terminal, which in the course of a rotating cycle, rises to a level above the hub and then falls to a level below the hub while moving around the hub;

(b) an article supporting member pivoted on each terminal; and (c) toy objects dangling from different sides of each article supporting member, animated as each terminal traverses around the hub, wherein (d) said objects differ in weight and differentially load the article supporting member to cause it to change its tilt under the influence of gravity.

27. A toy mobile according to claim 26, wherein each article supporting member has a periphery spaced from its respective terminal and said objects dangle from said periphery.

28. A toy mobile according to claim 27, wherein said periphery extends continuously around said respective terminal.

29. A toy mobile comprising:

(a) a spider having a hub drivable by a motor to rotate the spider around the hub; and having at least two legs radiating from the hub at an angle thereto, each leg having an end terminal which, in the course of a rotating cycle, rises to a level above the hub and then falls to a level below the hub while moving around the hub;

(b) beads slideably mounted on said legs of the spider which, in the course of a rotating cycle, slide toward and away from the hub and/or the terminal of each leg under the influence of gravity.

30. A toy mobile comprising:

(a) a spider having a hub drivable by a motor to rotate the spider around the hub; and having at least two legs radiating from the hub at an angle thereto, each leg having an end terminal which, in the course of a rotating cycle, rises to a level above the hub and then falls to a level below the hub while moving around the hub;

(b) an article supporting member having a vertical axis and being pivotally mounted on the terminal of at least one of the legs; and (c) toy objects dangling from different sides of the article supporting member, animated as the terminal of the at least one of the legs traverses around the hub, wherein (d) said objects differ in weight to unbalance the article supporting member which, in the absence of the toy objects, would be balanced with respect to said vertical axis, to thereby differentially load the article supporting member to cause it to change its tilt under the influence of gravity.

* * * * *